US009527684B2

(12) United States Patent
Nishioka et al.

(10) Patent No.: US 9,527,684 B2
(45) Date of Patent: Dec. 27, 2016

(54) SHEET FEEDING DEVICE AND IMAGE FORMING APPARATUS

(71) Applicant: KYOCERA Document Solutions Inc., Osaka (JP)

(72) Inventors: Nobuhiro Nishioka, Osaka (JP); Hironori Daigo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/889,096

(22) PCT Filed: Mar. 3, 2015

(86) PCT No.: PCT/JP2015/056193
§ 371 (c)(1),
(2) Date: Nov. 4, 2015

(87) PCT Pub. No.: WO2015/133466
PCT Pub. Date: Sep. 11, 2015

(65) Prior Publication Data

US 2016/0075529 A1 Mar. 17, 2016

(30) Foreign Application Priority Data

Mar. 5, 2014 (JP) ..... 2014-042975

(51) Int. Cl.
*B65H 1/00* (2006.01)
*B65H 1/26* (2006.01)
(Continued)

(52) U.S. Cl.
CPC ..... *B65H 1/266* (2013.01); *B65H 1/04* (2013.01); *B65H 7/20* (2013.01); *B65H 9/08* (2013.01);
(Continued)

(58) Field of Classification Search
CPC ... B65H 2511/01; B65H 2511/10; B65H 9/08; B65H 9/08
See application file for complete search history.

(56) References Cited

U.S. PATENT DOCUMENTS 8,205,875 B2 6/2012 Kusumi
2008/0117482 A1 5/2008 Kusumi

FOREIGN PATENT DOCUMENTS

JP 2003-246495 A 9/2003
JP 2006-188357 A 7/2006
JP 2008-127110 A 6/2008

OTHER PUBLICATIONS

International Search Report, PCT/JP2015/056193, Jun. 2, 2015.

*Primary Examiner* — Howard Sanders
(74) *Attorney, Agent, or Firm* — Studebaker & Brackett PC

(57) ABSTRACT

A sheet feeding device (1) includes a cassette (10), size detector (60), and attachment detector (30). The size detector (60) detects the size of sheets in the cassette (10). The size detector (60) includes an interlocking member (61) and switch unit (81). The interlocking member (61) includes size-detection target portions (64) and slides to sliding of a regulating member (11). The switch unit (81) detects a position of the regulating member (11) based on a state of the switches (82) that detect the size-detection target portions (64). The attachment detector (30) includes an attachment-detection target member (31) and attachment detecting member (41). The attachment detecting member (41) detects the attachment-detection target member (31) in response to attachment of the cassette (10). The controller (70) detects the sheet size based on a state of the switch unit (81) in response to the attachment detector (30) detecting attachment of the cassette (10).

10 Claims, 9 Drawing Sheets

(51) Int. Cl.

| | |
|---|---|
| ***B65H 1/04*** | (2006.01) |
| ***B65H 7/20*** | (2006.01) |
| *B65H 9/08* | (2006.01) |

(52) U.S. Cl.
CPC ..... *B65H 2511/10* (2013.01); *B65H 2511/20* (2013.01); *B65H 2553/00* (2013.01); *B65H 2553/612* (2013.01)

SHEET FEEDING DEVICE AND IMAGE FORMING APPARATUS

TECHNICAL FIELD

The present invention relates to a sheet feeding device for feeding a sheet and an image forming apparatus.

BACKGROUND ART

The sheet size detecting device disclosed in Patent Literature 1 includes a pair of side fences, an end fence, a size detection switch, a side-fence rotating member, and an end-fence rotating member.

The size detection switch includes a plurality of push switches. The side-fence rotating member includes a plurality of first projections. The end-fence rotating member includes a plurality of second projections. The plurality of first projections and the plurality of second projections constitute a plurality of composite projections. Depending on the positions of the side fences and the end fence, different composite projections are located opposite to the push switches. Each composite projection pushes a push switch that is located opposite to the composite projection. Therefore, the size of a sheet (hereinafter "sheet size") can be detected based on the state of the plurality of push switches. The state of the push switches refers to the combination of the states of the respective switches (ON and OFF).

Hereinafter, the side fences and the end fence are generally referred to as "fences". The side-fence rotating member and the end-fence rotating member are generally referred to as "rotating members".

Positions of the rotating members may slightly deviate from prescribed positions corresponding to a sheet size. The deviation from the prescribed positions may be caused by structural variation of the components, such as the size detection switch and the rotating members, or by variation in user operations of manipulating the fences. Securing the rotating members at deviated positions may result in error in sheet size detection.

To address the above, a means for correcting a securing position is provided. The securing position correcting means corrects the position of the rotating members to the prescribed positions immediately before the rotating members are secured (position correction). As a result, the positional accuracy of the rotating members improves and error in sheet size detection is prevented.

CITATION LIST

Patent Literature

[Patent Literature 1]
Japanese Patent Application Laid-Open Publication No. 2006-188357

SUMMARY OF INVENTION

Technical Problem

Unfortunately, the sheet size detecting device disclosed in Patent Literature 1 is associated with the following problems. That is, error in sheet size detection may occur due to variations in timing with which the plurality of push switches are pushed (hereinafter, "push timing").

The variations in push timing of the plurality of push switches may result not only from the structural variation of the components such as the size detection switch and the rotating members but also often from variation in user operations of attaching a paper feed cassette. In addition, variation in user operations of attaching a paper feed cassette is assumed to be greater than variation in user operations of moving a fence.

Therefore, even though the positional accuracy of the rotating members is improved and the influence of the structural variation as well as the variation in user operations of moving a fence are reduced, push timing of the plurality of push switches may still vary due to variation in user operations of attaching a paper feed cassette. As a result, error in sheet size detection may occur.

The sheet size detection based on the state of the plurality of push switches is affected by the detection of attachment of the paper feed cassette and the settlement of the states of the plurality of push switches.

Typically, attachment of a paper feed cassette to the image forming apparatus is detected by the size detection switch. In other words, attachment of a paper feed cassette to the image forming apparatus is detected when one or more of the push switches are pushed by the paper feed cassette. Upon detection of attachment of the paper feed cassette to the image forming apparatus, a timer is activated. Upon expiry of a predetermined time period, the sheet size is detected based on the state of the plurality of push switches. Therefore, the states of the respective push switches are regarded as settled upon expiry of the predetermined time period.

However, the push timing of the plurality push switches varies. Naturally, variation also occur as to when attachment of the paper feed cassette is detected, i.e., when the timer is activated, which results in variations as to when the states of the plurality of push switches are settled. This may cause detection of the sheet size before the states of all the push switches are actually settled, which leads to error in sheet size detection. For example, the time taken from detection of attachment of the paper feed cassette to a push of the last one of the push switches may exceed a prescribed time period measured by the timer. In that case, the states of the plurality of push switches are not actually settled and thus error in sheet size detection may occur.

The present invention is made in view of the problems noted above and aims to provide a sheet feeding device and an image forming apparatus that can each restrict error in sheet size detection.

Solution to Problem

According to a first aspect of the present invention, a sheet feeding device includes a cassette receiving section, a cassette, a size detector, an attachment detector, and a controller. The cassette is detachably attached to the cassette receiving section and to be loaded with a plurality of sheets. The size detector detects a size of the sheets loaded in the cassette. The attachment detector detects attachment of the cassette to the cassette receiving section. The cassette includes a regulating member that is slidable relative to the cassette and aligns edges of the sheets. The size detector includes an interlocking member and a switch unit. The interlocking member is disposed on the cassette and includes a plurality of size-detection target portions. The interlocking member moves in conjunction with sliding of the regulating member. The switch unit is disposed on an inner wall of the cassette receiving section so as to be opposite to the cassette and includes a plurality of switches. The switch unit detects a position of the regulating member based on a state of the plurality of switches that detect the plurality of size-detection target portions. The attachment detector includes an attachment-detection target member and an attachment detecting member. The attachment-detection target member is disposed on the cassette. The attachment detecting member is disposed on the inner wall of the cassette receiving section so as to be spaced from the switch unit and opposite to the attachment-detection target member. The attachment detecting member detects the attachment-detection target member in response to attachment of the cassette to the cassette receiving section. The controller detects the size of the sheets based on a state of the switch unit in response to the attachment detector detecting attachment of the cassette to the cassette receiving section.

According to a second aspect of the present invention, an image forming apparatus includes the sheet feeding device according to the first aspect described above and an image forming section. The image forming section forms an image on a sheet fed from the sheet feeding device.

Advantageous Effects of Invention

According to the present invention, the attachment detector detects attachment of the cassette independently of the size detector. Consequently, variations as to when attachment of the cassette is detected by the controller are reduced, which consequently reduces variations as to when the states of the plurality of switches are settled. This reduces the probability of the sheet size detection being carried out before the states of the plurality of switches are actually settled and therefore reduces occurrence of error in the sheet size detection.

DESCRIPTION OF EMBODIMENTS

The following describes embodiments of the present invention with reference to the accompanying drawings. In the figures, the same or corresponding parts are denoted by the same reference signs, and a description thereof is not repeated.

Embodiment 1

Basic Principle

Figure 1:
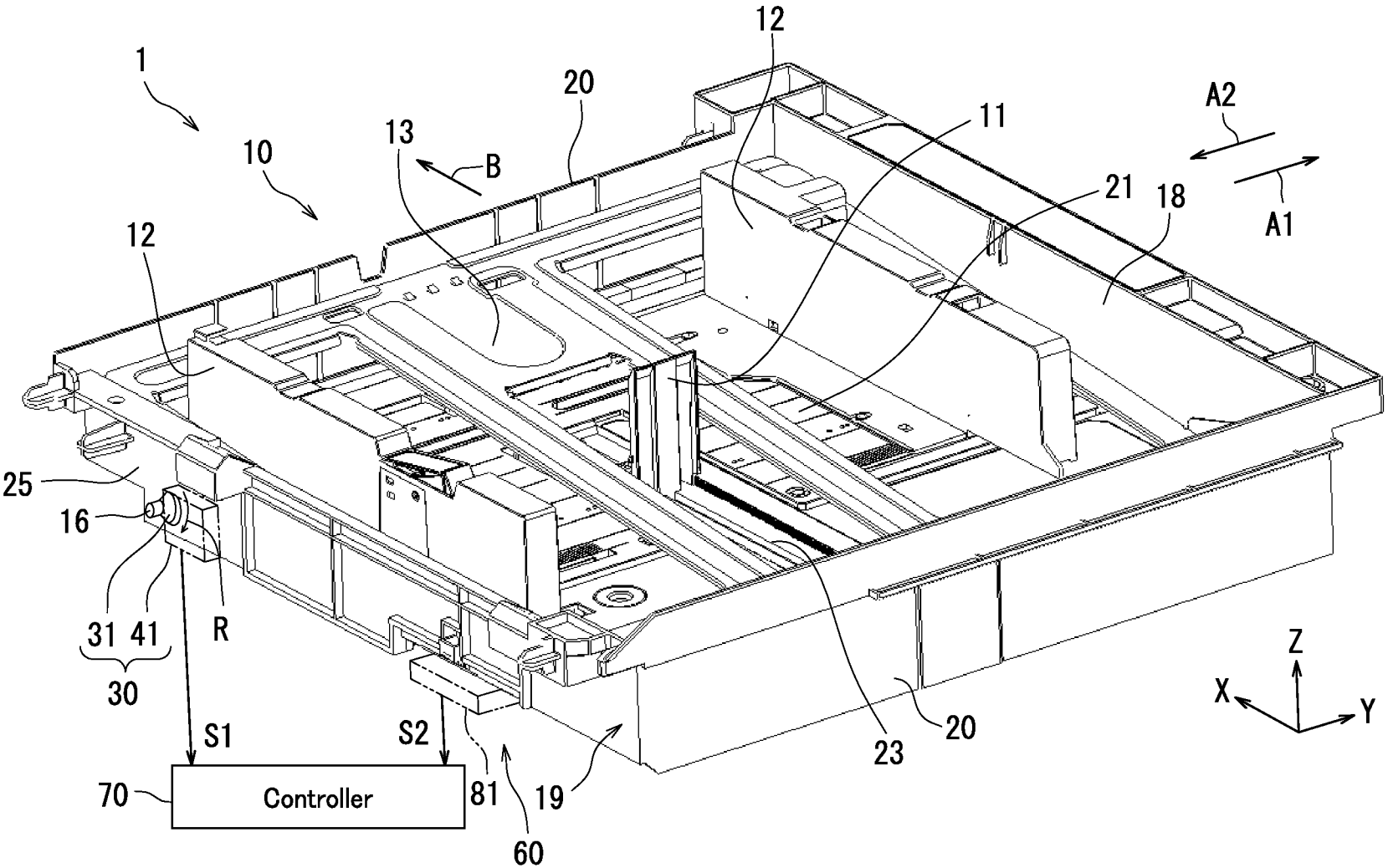
FIG. 1 is a perspective view showing a sheet feeding device according to Embodiment 1 of the present invention.
Figure 2:
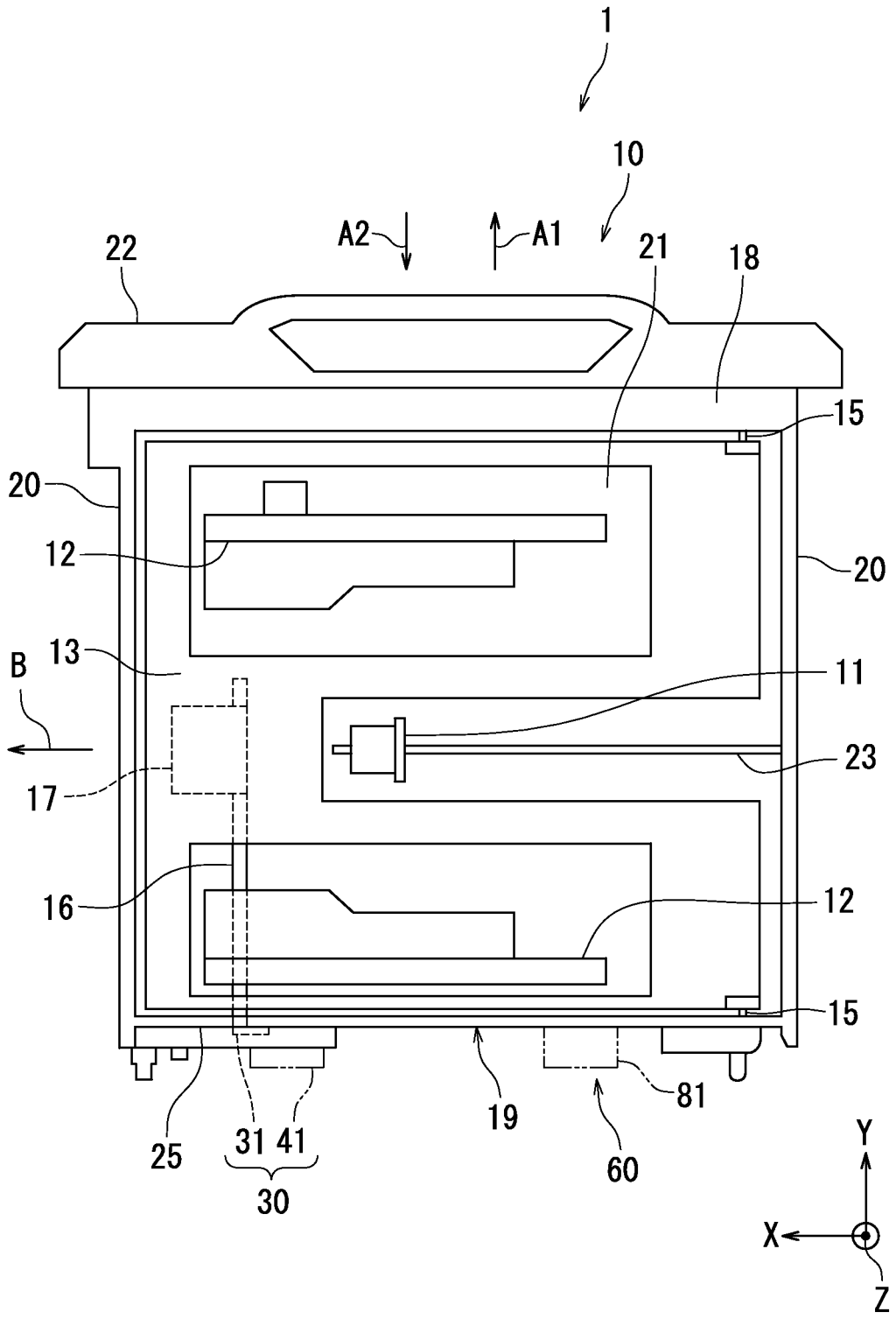
FIG. 2 is a plan view showing the sheet feeding device according to Embodiment 1 of the present invention.
Figure 3:
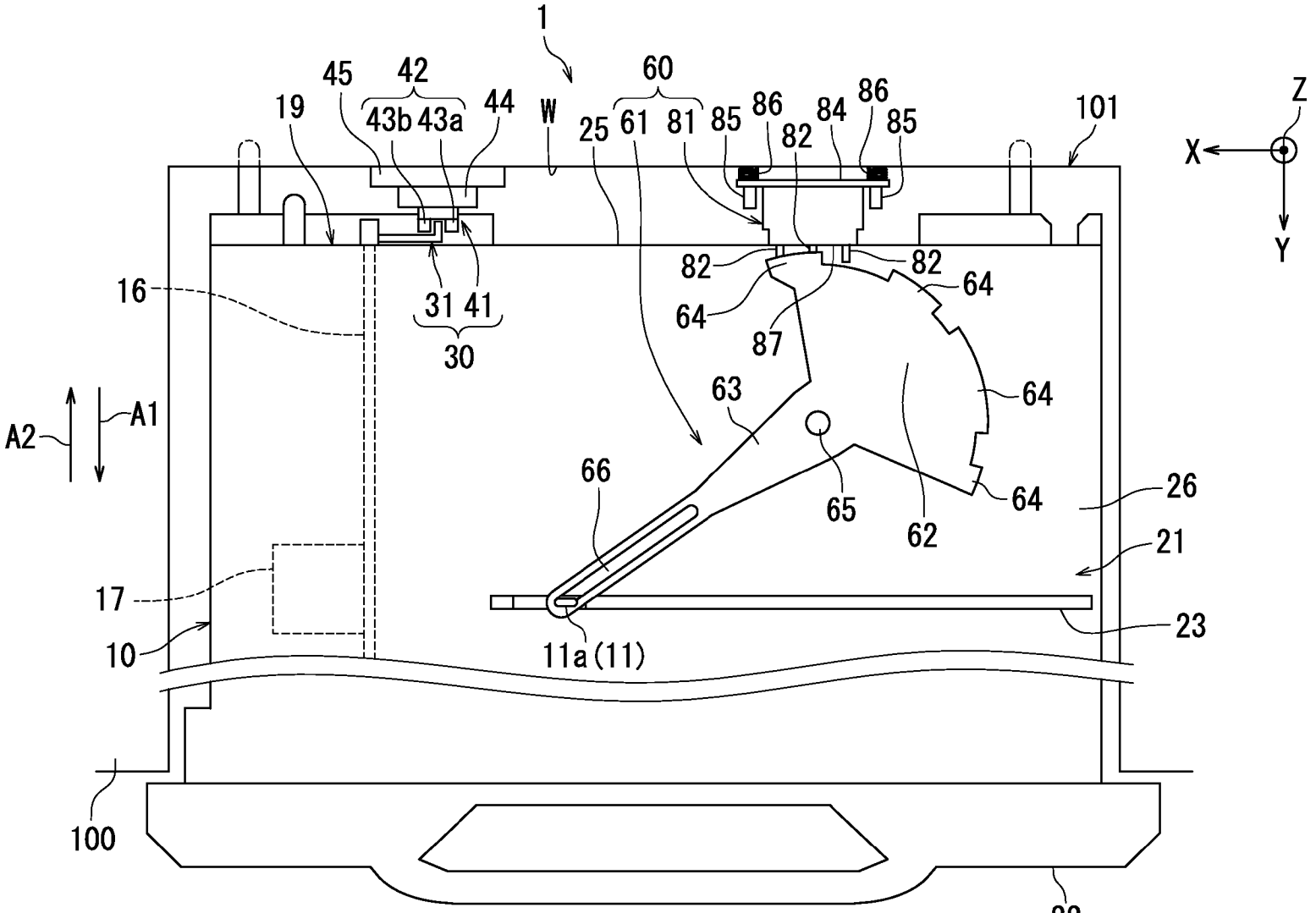
FIG. 3 is a bottom view showing the sheet feeding device according to Embodiment 1 of the present invention.

With reference to FIGS. 1 to 3, the following describes the basic principle of a sheet feeding device 1 according to Embodiment 1 of the present invention. FIGS. 1, 2, and 3 are respectively a perspective view, a plan view, and a bottom view showing the sheet feeding device 1. The sheet feeding device 1 includes a cassette receiving section 101 (see FIG. 3), a cassette 10, a size detector 60, an attachment detector 30, and a controller 70.

The cassette 10 is detachably attached to the cassette receiving section 101. The cassette 10 is loaded with a plurality of sheets. The size detector 60 detects the size of the plurality of sheets loaded in the cassette 10. The attachment detector 30 detects attachment of the cassette 10 to the cassette receiving section 101.

The cassette 10 includes a rear-edge regulating member 11 (regulating member). The rear-edge regulating member 11 is slidable relative to the cassette 10 and aligns the rear edges of the plurality of sheets. The size detector 60 includes an interlocking member 61 and a switch unit 81. The interlocking member 61 is disposed on the cassette 10 and includes a plurality of protrusions 64 (detection target pieces). In the following description of the present specification, the protrusions 64 are referred to as the "size-detection target portions 64". The interlocking member 61 moves in conjunction with sliding of the rear-edge regulating member 11. The switch unit 81 is disposed on an inner wall W of the cassette receiving section 101 so as to be opposite to the cassette 10.

The switch unit 81 includes a plurality of switches 82. The switch unit 81 detects the position of the rear-edge regulating member 11 by detecting the position of the interlocking member 61 based on the state of the plurality of switches 82 that detect the plurality of size-detection target portions 64. Each switch 82 is for example a microswitch. A microswitch is a miniature switch that includes a contact mechanism and an actuator. The contact mechanism is housed in a case. The contact mechanism has a short contact gap and a snap action mechanism. The actuator is located externally of the case.

The attachment detector 30 includes a detection target section 31 and a detecting section 41. In the following description of the present specification, the detection target section 31 is referred to as the "attachment-detection target member 31" and the detecting section 41 is referred to as the "attachment detecting member 41". The attachment-detection target member 31 is disposed on the cassette 10. The attachment detecting member 41 is disposed on the inner wall W of the cassette receiving section 101 so as to be spaced from the switch unit 81 and opposite to the attachment-detection target member 31. The attachment detecting member 41 detects the attachment-detection target member 31 in response to attachment of the cassette 10 to the cassette receiving section 101. In response to the attachment detector 30 detecting attachment of the cassette 10 to the cassette receiving section 101, the controller 70 detects the sheet size based on the state of the switch unit 81.

According to Embodiment 1, the attachment detector 30 detects attachment of the cassette 10 independently of the size detector 60. Consequently, variations as to when attachment of the cassette 10 is detected by the controller 70 are reduced, which consequently reduces variations as to when the states of the plurality of switches 82 are settled. This reduces the probability of the sheet size detection being carried out before the states of the plurality of switches 82 are actually settled and therefore reduces occurrence of error in the sheet size detection.

[Structure of Cassette 10]

With reference to FIGS. 1 to 3, the structure of the cassette 10 is described. In Embodiment 1, the X axis and the Y axis are each straight and parallel to the horizontal plane, and the Z axis is parallel to the vertical direction. The cassette 10 is pulled out of the cassette receiving section 101 provided in the image forming apparatus 100 through movement in a pulling direction A1. The cassette 10 is inserted into the cassette receiving section 101 through movement in an insertion direction A2. The pulling direction A1 and the insertion direction A2 are both along the Y axis. The pulling direction A1 is the reverse direction of the insertion direction A2. In the present specification, the insertion direction A2 may be also referred to as the first direction, whereas the pulling direction A1 may be also referred to as the second direction. Sheets (not illustrated) are fed in a feed direction B. The feed direction B is along the X axis direction. The direction orthogonal to the feed direction B is along the Y axis.

The positive X axis direction is toward the front of the sheets, whereas the negative X axis direction is toward the rear of the sheets. The positive Y direction is toward the front of the cassette 10, whereas the negative Y direction is toward the rear of the cassette 10.

The cassette 10 is in a shape of a rectangular parallelepiped that is open at the top. The cassette 10 has a front end 18, a rear end 19, a pair of side ends 20, a bottom portion 21, and a panel 22. Note that FIG. 1 omits the panel 22. The bottom portion 21 is a rectangular plate that is parallel to the XY plane. The front end 18 is a wall portion that is upright from the front edge of the bottom portion 21 and extends along the X axis. The panel 22 is placed on the frontmost face of the front end 18. The rear end 19 is a wall portion that is opposite to the front end 18, uprights from the rear edge of the bottom portion 21, and extends along the X axis. The side ends 20 are opposing wall portions that are upright from the respective side edges of the bottom portion 21 and extend along the Y axis.

The cassette 10 includes a rear-edge regulating member 11 and a pair of side-edge regulating members 12. The cassette 10 includes a guide 23 formed therein. The guide 23 extends along the X axis. The rear-edge regulating member 11 is a plate-like member upstanding along the Z axis. The rear-edge regulating member 11 is movable along the guide 23.

The pair of side-edge regulating members 12 are plate-like members disposed opposite to each other. Each of the side edge regulating members 12 upstands along the Z axis and extends along the X axis direction. The side-edge regulating members 12 are in cooperative relation with each other and are movable toward or away from each other along the Y axis.

The cassette 10 includes a loading member 13. The loading member 13 is a plate-like member disposed on the upper surface of the bottom portion 21. The loading member 13 is in the shape of a letter U so as not to interfere with movement of the rear-edge regulating member 11. The loading member 13 has a pair of rectangular openings correspondingly to the pair of side-edge regulating members 12. The loading member 13 therefore does not interfere with movement of the pair of side-edge regulating members 12.

The loading member 13 is loaded with a plurality of sheets. More specifically, the plurality of sheets are loaded on a loading surface that is defined by the upper surface of the loading member 13 and the upper surface of the bottom portion 21. The rear-edge regulating member 11 aligns the rear edges of the plurality of sheets loaded on the loading surface. One of the side-edge regulating members 12 aligns the edges of the plurality of sheets loaded on the loading surface along one side, and the other one of the side-edge regulating members 12 aligns the edges of the plurality of the sheets loaded on the loading surface along the other side. Consequently, the size of sheets loadable into the cassette 10 is set by the rear-edge regulating member 11 and the pair of side-edge regulating members 12. The size of sheets loadable into the cassette 10 can be changed by moving the rear-edge regulating member 11 and the pair of side-edge regulating members 12.

[Lift Mechanism of Loading Member 13]

With reference to FIG. 2, the mechanism for lifting up and down the loading member 13 is described. The cassette 10 includes a pair of shafts 15. One of the shafts 15 is formed on the inner wall of the front end 18 and the other of the shafts 15 is formed on the inner wall of the rear end 19, both at an upstream position in terms of the feed direction B. The upstream end of the loading member 13 in terms of the feed direction B is rotatably supported on the pair of shafts 15. The downstream end of the loading member 13 in terms of the feed direction B is a free end.

The cassette 10 includes a shaft 16 and a plate-like lift member 17. The shaft 16 rotates according to the loading amount of a plurality of sheets. The lift member 17 abuts against the lower surface of the loading member 13, which is an opposite surface to the sheet loading surface, and rotates with the shaft 16 to lift up and down the loading member 13. More specific description is as follows.

The shaft 16 is located on the bottom portion 21 at a position downstream of the downstream end of the rear-edge regulating member 11 in terms of the feed direction B. The shaft 16 penetrates through the rear end 19 along the Y axis. The lift member 17 is located between the bottom portion 21 and the loading member 13. The lift member 17 is located downstream of the downstream end of the rear-edge regulating member 11 in terms of the feed direction B.

An upstream end of the lift member 17 in terms of the feed direction B is secured to the shaft 16. A downstream end of the lift member 17 is a free end. The lift member 17 thus rotates in conjunction with rotation of the shaft 16. The shaft 16 is coupled to a motor (not illustrated) as a driving source. The motor rotates the shaft 16 and the lift member 17 under control of the controller 70 (see FIG. 1).

When the shaft 16 rotates in a rotation direction R (see FIG. 1), the lift member 17 rotates in a direction corresponding to the rotation direction R. Consequently, the downstream end of the lift member 17 in terms of the feed direction B ascends while in abutment against the lower surface of the loading member 13. In other words, the loading member 13 rotates on the shaft 15 to lift up the downstream end of the loading member 13.

When the shaft 16 rotates in the reverse direction of the rotation direction R, the lift member 17 rotates in a direction corresponding to the reverse rotation direction. Consequently, the downstream end of the lift member 17 descends while in abutment against the lower surface of the loading member 13. In other words, the loading member 13 rotates on the shaft 15 to lift down the downstream end of the loading member 13.

When the loading amount of sheets is large, the lower surface of the loading member 13 is in contact with the upper surface of the bottom portion 21 and the loading member 13 is held substantially horizontal. As the loading amount of sheets decreases, the shaft 15 rotates in the rotation direction R. Consequently, the downstream end of the lift member 17, as well as the downstream end of the loading member 13, ascends to tilt the loading member 13. In other words, the tilt angle of the loading member 13 increases with a decrease in the loading amount of sheets.

[Structure of Attachment Detector 30]

Figure 4A:
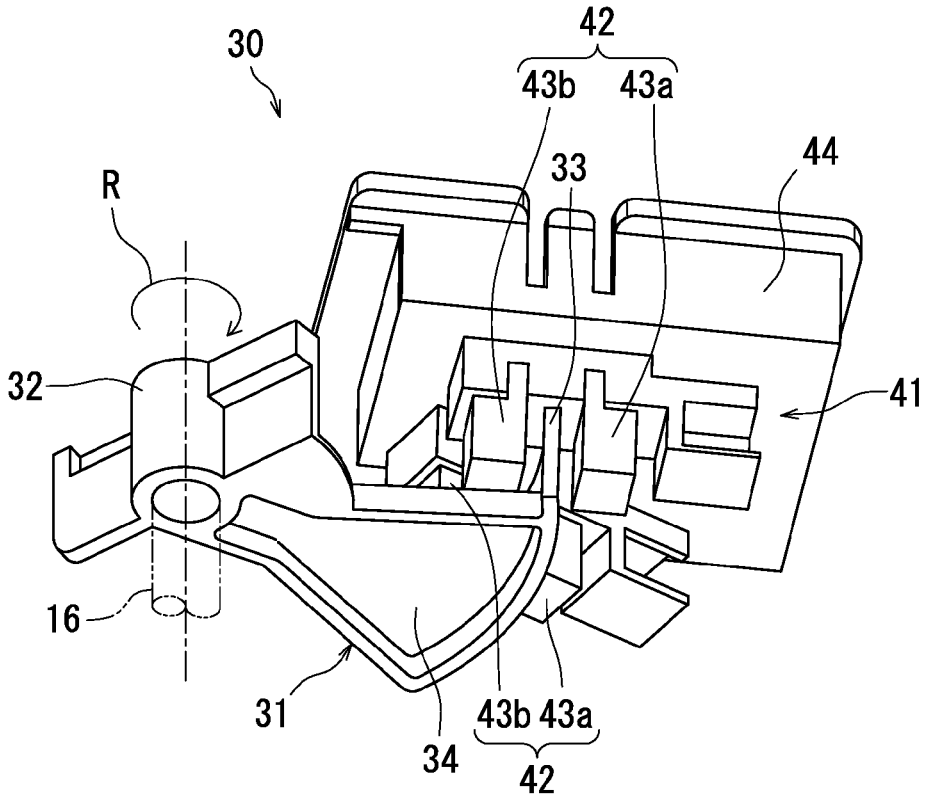
FIG. 4A is a perspective view showing an attachment detector included in the sheet feeding device according to Embodiment 1 of the present invention.
Figure 4B:
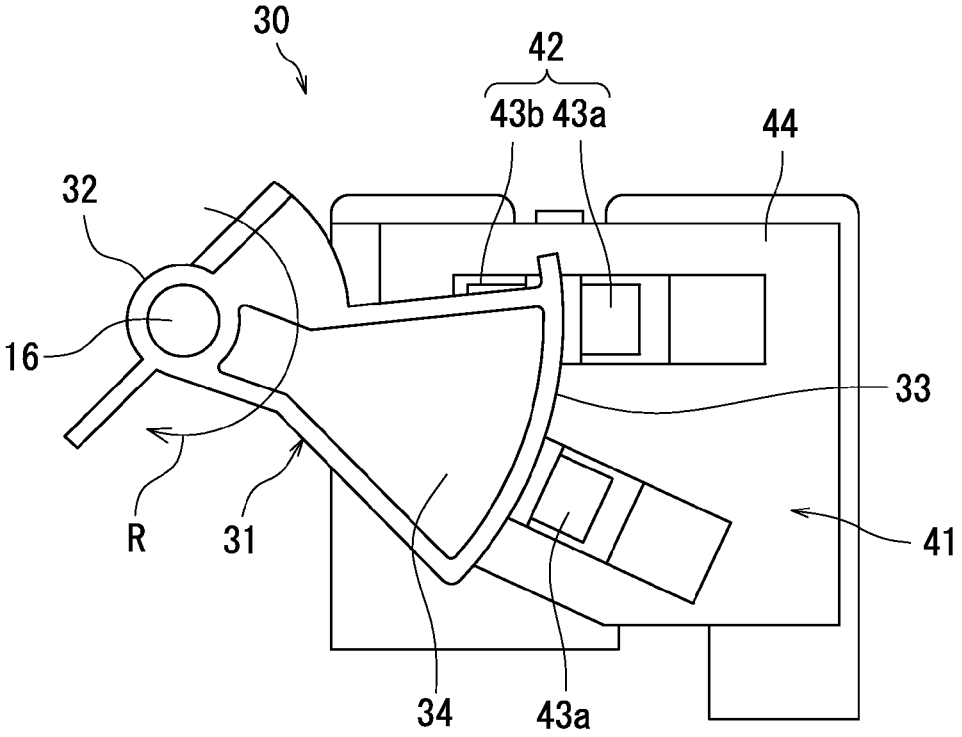
FIG. 4B is a plan view showing the attachment detector included in the sheet feeding device according to Embodiment 1.

With reference to FIGS. 3, 4A, and 4B, the structure of the attachment detector 30 is described. FIG. 3 shows the cassette receiving section 101 with the cassette 10 attached thereto. FIG. 4A is a perspective view and FIG. 4B is a plan view showing the attachment detector 30. The attachment detector 30 functions also as a load amount detector that detects the loading amount of sheets on the loading member 13.

The attachment-detection target member 31 of the attachment detector 30 is disposed on the cassette 10. More specially, the attachment-detection target member 31 is disposed at the end of the shaft 16. The attachment-detection target member 31 rotates in conjunction with rotation of the shaft 16. In other words, the attachment-detection target member 31 rotates integrally with the shaft 16. The attachment detecting member 41 is disposed on the image forming apparatus 100. The attachment detecting member 41 detects the attachment-detection target member 31. According to Embodiment 1, the attachment detecting member 41 detects the attachment-detection target member 31 blocking an optical path. In other words, the attachment detecting member 41 detects blocking of the optical path by the attachment-detection target member 31 upon attachment of the cassette 10 to the cassette receiving section 101. Additionally, when detecting the loading amount of sheets, the attachment detecting member 41 detects that the optical path is blocked by the attachment-detection target member 31 being rotated in conjunction with rotation of the shaft 16. The following provides a more specific description.

As shown in FIG. 3, the attachment-detection target member 31 is located on an outer wall 25 of the rear end 19 of the cassette 10. As shown in FIGS. 4A and 4B, the attachment-detection target member 31 includes a base end 32 and a sector portion 34. The base end 32 is secured to the shaft 16. Consequently, the attachment-detection target member 31 rotates in conjunction with rotation of the shaft 16 and the lift member 17 (see FIG. 3). The sector portion 34 has a distal end surface 33 defining a curved surface.

The attachment detecting member 41 includes a plurality of sensors, a sensor table 44, and a support table 45. The plurality of sensors 42 are arranged along the rotation direction of the attachment-detection target member 31. At least one of the sensors 42 detects blocking of a corresponding optical path by the attachment-detection target member 31 upon attachment of the cassette 10 to the cassette receiving section 101. Also, at least one of the sensors 42 detects blocking of a corresponding optical path by the attachment-detection target member 31 upon rotation of the attachment-detection target member 31 in conjunction with rotation of the shaft 16. According to Embodiment 1, two sensors are provided as the plurality of sensors 42. Each of the sensors 42 is for example a transmissive photointerrupter and includes a light emitter 43*a* and a light receiver 43*b*. Note that each sensor 42 may be a reflective photointerrupter. The sensors 42 are secured to the sensor table 44. The sensor table 44 is secured to the support table 45. The support table 45 is secured to the inner wall W of the cassette receiving section 101.

Each light emitter 43*a* emits light. Each light receiver 43*b* receives light emitted by the corresponding light emitter 43*a*. The distal end surface 33 of the attachment-detection target member 31 rotates with the shaft 16 to block or unblock the optical paths of light emitted by the individual light emitters 43*a*. Each of the light receivers 43*b* stays on while the corresponding optical path is left unblocked and goes off when the optical path is blocked.

The attachment detecting member 41 having the two sensors 42 can detect the rotation angle of the attachment-detection target member 31, that is, the rotation angle of the shaft 16, at four levels based on the state of the two sensors 42. The state of the two sensors 42 refers to the combination of the respective states of the sensors 42 (on or off). The shaft 16 rotates in conjunction with rotation of the lift member 17 and the rotation angle of the lift member 17 determines the tilt angle of the loading member 13. With a decrease in the loading amount of sheets on the loading member 13, the shaft 16 rotates in the rotation direction R to change the tilt angle of the loading member 13.

Therefore, the loading amount of sheets can be detected by detecting the rotation angle of the shaft 16. According to Embodiment 1, the rotation angle of the shaft 16 is detectable at four levels and therefore the loading amount of sheets can also be detected at four levels.

The signal indicating the state of the two sensors 42, that is, a state signal S1 indicating the state of the attachment detecting member 41, is output to the controller 70 (see FIG. 1). Consequently, the controller 70 can detect the loading amount of sheets at four levels based on the state signal S1 of the attachment detecting member 41. In other words, the controller 70 detects the loading amount of sheets based on the states of the plurality of sensors 42.

[Structure of Size Detector 60]

The structure of the size detector 60 is described with reference to FIG. 3. The size detector 60 includes an interlocking member 61 and a switch unit 81. The switch unit 81 has an abutting surface 87 that is opposite to the outer wall 25 of the cassette 10. The plurality of switches 82 each protrude in the pulling direction A1 from the abutting surface 87. According to Embodiment 1, three switches are provided as the plurality of switches 82.

The interlocking member 61 is disposed on a lower surface 26 of the bottom portion 21 of the cassette 10. The lower surface 26 is an opposite surface of the bottom portion 21 to the upper surface (i.e., the loading surface). The interlocking member 61 has a sector portion 62 and an arm portion 63. The sector portion 62 has an arc-shaped end at which the plurality of size-detection target portions 64 are formed. The sector portion 62 has a root portion through which a shaft 65 penetrates. The shaft 65 is formed on the bottom portion 21 so as to be orthogonal to the lower surface 26.

The arm portion 63 is formed continuous with the root portion of the sector portion 62. A guide 66 is formed in the arm portion 63. The guide 66 has a slot and extends from the tip portion of the arm portion 63 in the direction of the shaft 65. The guide 66 loosely receives the bottom portion 11*a* of the rear-edge regulating member 11. When the rear-edge regulating member 11 moves along the guide 23, the bottom portion 11*a* of the rear-edge regulating member 11 moves along the guide 66. As a result, the interlocking member 61 (sector portion 62) rotates on the shaft 65.

The sector portion 62 rotates according to the position of the rear-edge regulating member 11. As a result, all or at least one of the three switches 82 are pushed by one or more of the plurality of size-detection target portions 64 or none of the three switches 82 is pushed by any of the plurality of size-detection target portions 64. The state of the three switches 82 therefore changes according to the position of the rear-edge regulating member 11. As a result, the sheet size corresponding to the position of the rear-edge regulating member 11, that is, the size of sheets loaded in the cassette 10, can be detected based on the state of the three switches 82. The state of the three switches 82 refers to the combination of the states of the respective switches 82 (pushed state or unpushed state).

A signal indicating the state of the three switches 82, i.e., a state signal S2 indicating the state of the switch unit 81, is output to the controller 70 (see FIG. 1). Therefore, the controller 70 detects the size of sheets loaded in the cassette 10 based on the state signal S2 of the switch unit 81.

[Process of Detecting Sheet Size]

Figure 5A:
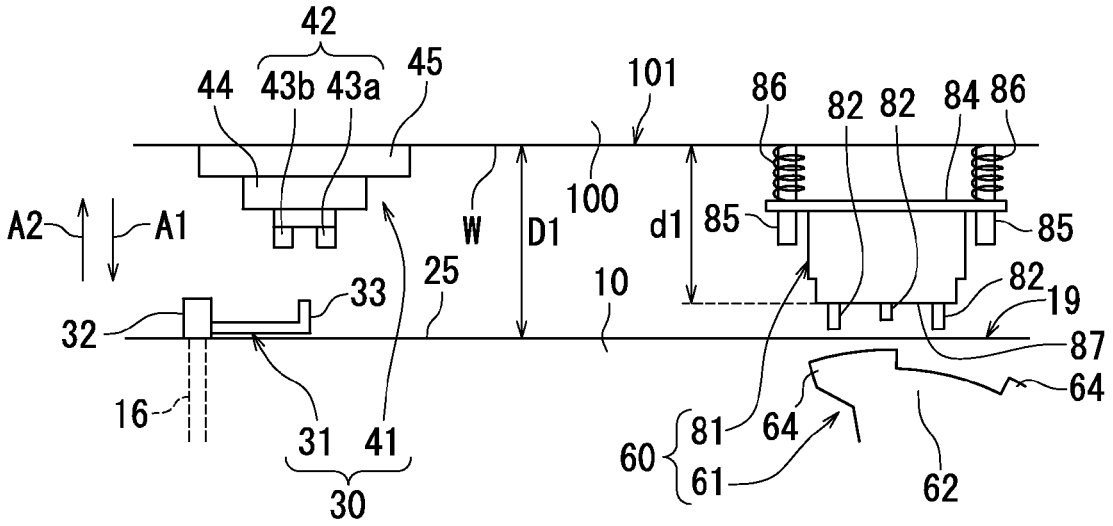
FIG. 5A illustrates a process of attaching a cassette of the sheet feeding device according to Embodiment 1 of the present invention to a cassette receiving section included in an image forming apparatus.
Figure 5B:
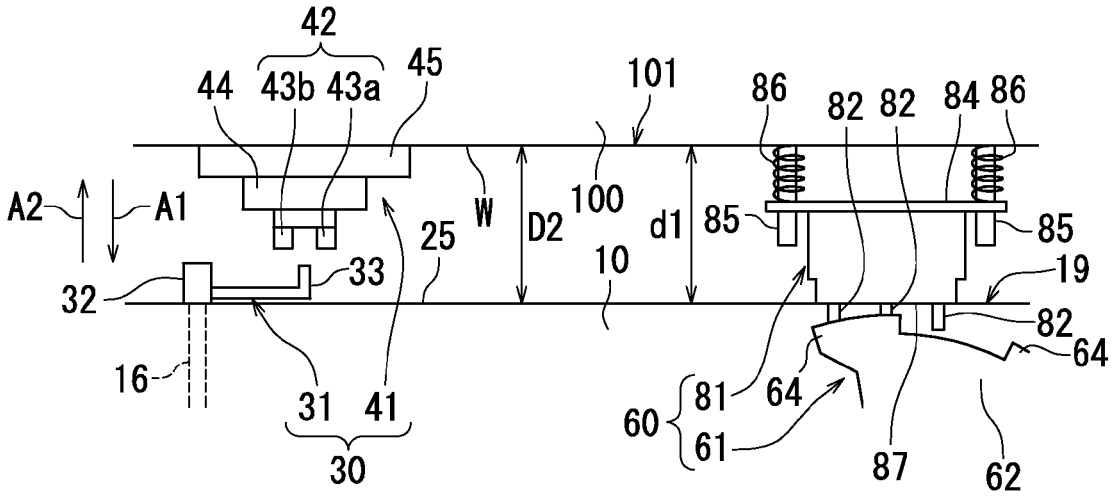
FIG. 5B illustrates the process of attaching the cassette of the sheet feeding device according to Embodiment 1 of the present invention to the cassette receiving section included in the image forming apparatus.
Figure 5C:
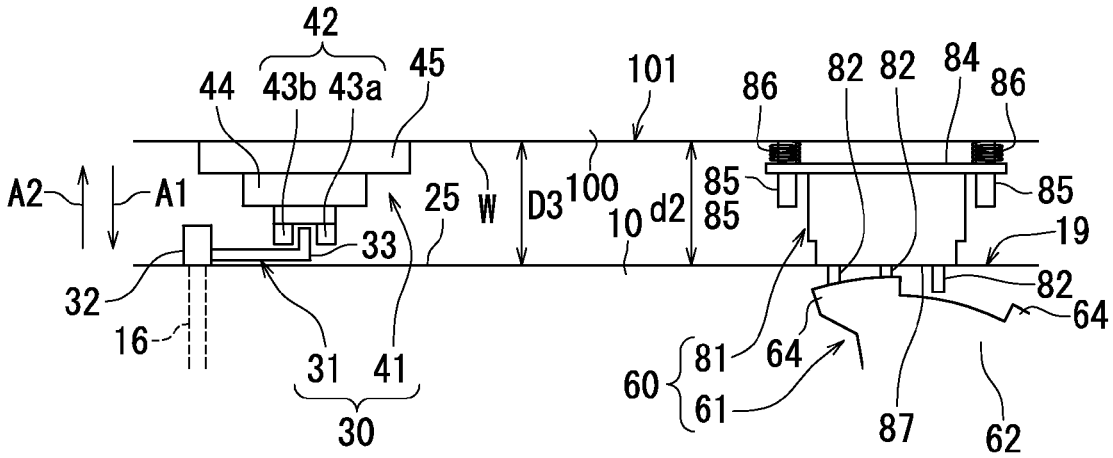
FIG. 5C shows the process of attaching the cassette of the sheet feeding device according to Embodiment 1 of the present invention to the cassette receiving section included in the image forming apparatus.

A process of detecting the size of sheets is described with reference to FIG. 5A to 5C. FIGS. 5A to 5C illustrate the process of attaching the cassette 10 to the cassette receiving section 101. FIG. 5A shows the state in which the attachment-detection target member 31 does not block the optical paths of the attachment detecting member 41 and none of the switches 82 of the switch unit 81 is pushed by the interlocking member 61. This state of the switch unit 81 is referred to as a "standard state".

In the standard state, the switch unit 81 is supported such that the distance between the abutting surface 87 of the switch unit 81 and the inner wall W of the cassette receiving section 101 is equal to a prescribed distance dl. The following provides a more specific description.

The size detector 60 has a support member 84, a pair of guide members 85, and a pair of elastic members 86 (first elastic members). Each guide member 85 is, for example, in a cylindrical shape and protrudes in the pulling direction A1 from the inner wall W. Each elastic member 86 is for example a spring. The elastic members 86 are fitted over the respective guide members 85. In other words, the elastic members 86 are disposed on the inner wall W of the cassette receiving section 101. The guide members 85 are loosely received on the support member 84 at the respective ends. Each elastic member 86 is located between the support member 84 and the inner wall W so as to be extendable and contractible in the pulling direction A1 and the insertion direction A2.

A restricting member (not shown) prohibits the support member 84 from moving beyond the prescribed distance dl in the pulling direction A1. The switch unit 81 is secured to the support member 84. In the standard state, the switch unit 81 is urged in the pulling direction A1 by the elastic members 86 while staying at the prescribed distance dl.

In FIG. 5A, the distance between the outer wall 25 of the cassette 10 and the inner wall W of the cassette receiving section 101 is denoted as a distance D1. FIG. 5B shows the state in which the cassette 10 is further inserted in the insertion direction A2 from the state shown in FIG. 5A. The distance between the outer wall 25 and the inner wall W is denoted as a distance D2 (<D1). In this state, the attachment-detection target member 31 still does not block the optical paths of the attachment detecting member 41. Meanwhile, two of the switches 82 are pushed by one size-detection target portion 64. The outer wall 25 of the cassette 10 comes into abutment against the abutting surface 87 as a result of the switches 82 being pushed in the insertion direction A2 by the size-detection target portion 64. In other words, as the switches 82 are pushed, the abutting surface 87 of the switch unit 81 comes into abutment against the outer wall 25 of the cassette 10. Since FIG. 5B shows the state immediately after the pushing of the switches 82, the switch unit 81 is still substantially in the standard state. The attachment detecting member 41 and the attachment-detection target member 31 are disposed such that detection of the attachment-detection target member 31 by the attachment detecting member 41 does not occur at the same time as abutment of the outer wall 25 of the cassette 10 against the abutting surface 87.

From the state shown in FIG. 5B, the cassette 10 is further inserted into the insertion direction A2 against the elastic force of the elastic members 86. Then, the outer wall 25 eventually comes to press the abutting surface 87 in the insertion direction A2. As a result, the switch unit 81 moves in the insertion direction A2 with the state of the three switches 82 unchanged. In other words, upon attachment of the cassette 10 to the cassette receiving section 101, the outer wall 25 of the cassette 10 presses the abutting surface 87, causing the switch unit 81 to move in the insertion direction A2.

FIG. 5C shows the state in which the cassette 10 is further inserted in the insertion direction A2 from the state shown in FIG. 5B to complete attachment of the cassette 10 to the cassette receiving section 101. The distance between the outer wall 25 and the inner wall W is denoted as a distance D3 (<D2). In this state, the attachment-detection target member 31 blocks one or more of the optical paths of the attachment detecting member 41. That is, the distal end surface 33 of the attachment-detection target member 31 is inserted into a position between the light emitter 43*a* and the light receiver 43*b* of at least one of the sensors 42. Meanwhile the two switches 82 remain pushed by one size-detection target portion 64.

The state signal S1 of the attachment detecting member 41 and the state signal S2 of the switch unit 81 are output to the controller 70 (see FIG. 1). Upon detection of a transition from the state signal S1 indicating that none of the optical paths are blocked to the state signal S1 indicating that one or more of the optical paths are blocked, in other words, upon detection of attachment of the cassette 10, the controller 70 activates a timer (not illustrate) to start measuring a prescribed time period T. The controller 70 then detects the size of sheets loaded in the cassette 10 based on the state signal S2 of the switch unit 81 upon expiry of the prescribed time period T. The prescribed time period T is determined experimentally and/or empirically. The prescribed time period may be equal to 0.

After detection of attachment of the cassette 10 and the size of sheets, the controller 70 detects the loading amount of sheets based on the state signal S1 that is responsive to the amount of rotation of the attachment-detection target member 31. The plurality of switches 82, the plurality of size-detection target portions 64, the attachment-detection target member 41, and the attachment-detection target member 31 are disposed such that the attachment detecting member 41 detects the attachment-detection target member 31 after the size-detection target portions 64 push one or more of the switches 82 in the insertion direction A2 and then the outer wall 25 of the cassette 10 abuts against the abutting surface 87 upon attachment of the cassette 10 to the cassette receiving section 101.

As described with reference to FIGS. 1 to 5C, according to Embodiment 1, attachment of the cassette 10 is detected by the attachment detector 30 rather than by the size detector 60. This reduces variations as to when attachment of the cassette 10 is detected, i.e., when the timer is activated for measuring the prescribed time period T. Consequently, the timing with which the states of the plurality of switches 82 are settled is consistent. This restricts the sheet size detection by the controller 70 from being performed before the states of the plurality of switches 82 are actually settled and thus restricts error in the sheet size detection by the controller 70.

As described with reference to FIGS. 4A and 4B, according to Embodiment 1, the attachment detecting member 41 detects optical path blocking by the attachment-detection target member 31 upon attachment of the cassette 10 to the cassette receiving section 101. In other words, the attachment detector 30 can detect attachment of the cassette 10 through a simple structure. Furthermore, the attachment detector 30 detects the loading amount of sheets in addition to attachment of the cassette 10. This can lead to cost reduction as compared with a configuration in which a separate sensor is provided specifically for detecting the loading amount of sheets.

As described with reference to FIG. 5C, according to Embodiment 1, the attachment detecting member 41 detects the attachment-detection target member 31 after at least one of the switches 82 detects a size-detection target portion 64 of the interlocking member 61 upon attachment of the cassette 10 to the cassette receiving section 101. In other words, the attachment detecting member 41 detects the attachment-detection target member 31 after at least one of the switches 82 is pushed by a size-detection target portion 64. This increases the probability that the state of the plurality of switches 82 is settled by the time attachment of the cassette 10 is detected. As a result, the sheet size is more appropriately detected. Additionally, the prescribed time period T, which is measured starting from detection of attachment of the cassette 10, can be shortened to achieve faster processing.

As described with reference to FIGS. 5A to 5C, according to Embodiment 1, the cassette 10 is attached to the cassette receiving section 101 through movement in the insertion direction A2 (first direction), whereas the elastic members 86 urge the switch unit 81 in the pulling direction A1 (second direction) that is the reverse direction of the insertion direction A2. Consequently, impact associated with attachment of the cassette 10 can be absorbed by the elastic members 86.

The speed at which the cassette 10 is inserted is typically not the same for each user operation of attaching the cassette 10 and differs among individual users and environments. In addition, the speed at which the cassette 10 is inserted is often not constant and fluctuates. In addition, there may be a case where insertion of the cassette 10 is stopped temporarily after the interlocking member 61 pushes one switch 82 and then resumed to complete attachment of the cassette 10. In one such example, the cassette 10 bounces back due to initially being forcefully inserted and is then re-inserted. Typically, an attaching operation by a user affects the sheet size detection. However, Embodiment 1 can reduce the influence exerted by an attaching operation by a user on the sheet size detection.

Embodiment 2

Overview

With reference to FIGS. 1 to 2, the following describes the basic principle of a sheet feeding device 1 according to Embodiment 2 of the present invention. The sheet feeding device 1 according to Embodiment 2 is similar to the sheet feeding device 1 according to Embodiment 1, which has been described with reference to FIGS. 1 and 2.

The sheet feeding device 1 according to Embodiment 2 differs from Embodiment 1 with respect to the structure of the attachment detector 30 and the size detector 60. According to Embodiment 1, the attachment detecting member 41 detects the attachment-detection target member 31 after at least one switch 82 among the plurality of switches 82 is pushed by the interlocking member 61 (see FIGS. 5A to 5C). According to Embodiment 2, the attachment detecting member 41 detects the attachment-detection target member 31 before at least one switch 82 among the plurality of switches 82 detects a size detection target portion 64 of the interlocking member 61 upon attachment of the cassette 10 to the cassette receiving section 101. In other words, in the process of attaching the cassette 10, the attachment detecting member 41 detects the attachment-detection target member 31 before at least one switch among the plurality of switches 82 is pushed by a size detection target portion 64. The following mainly describes Embodiment 2 as to differences with Embodiment 1.

[Structure of Attachment Detector 30]

Figure 6:
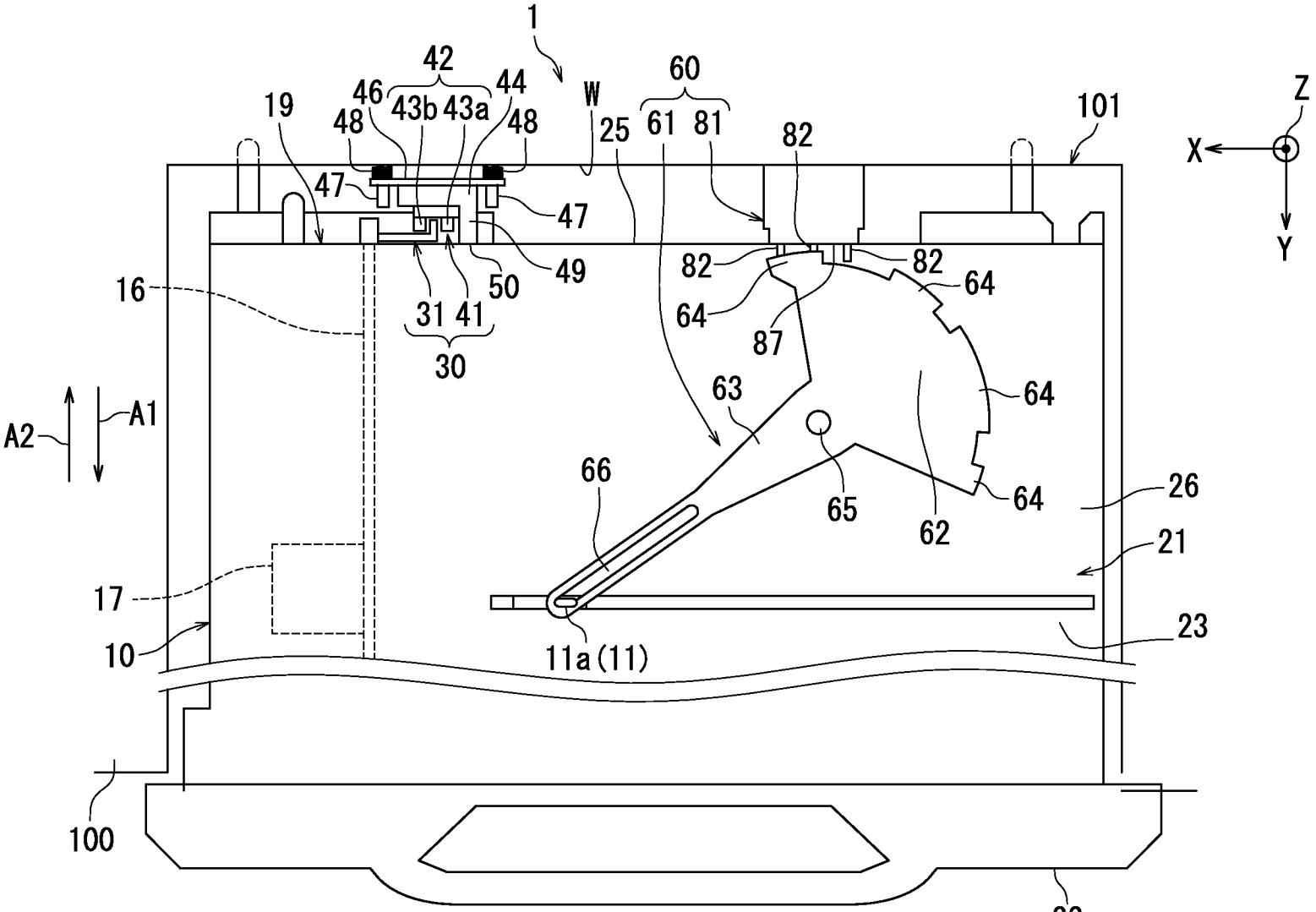
FIG. 6 is a bottom view showing a sheet feeding device according to Embodiment 2 of the present invention.

The structure of the attachment detector 30 is described with reference to FIGS. 6, 7A, and 7B. FIG. 6 is a bottom view showing the sheet feeding device 1. FIG. 6 shows the state in which the cassette 10 is attached to the cassette receiving section 101 provided in the image forming apparatus 100. The attachment detector 30 functions also as a load amount detector that detects the loading amount of sheets loaded on the loading member 13. The attachment detector 30 includes the attachment-detection target member 31, the attachment-detection target member 41, the support member 46, a pair of guide members 47, and a pair of elastic members 48 (second elastic members). The support member 46, the guide members 47, and the elastic members 48 are described later.

Figure 7A:
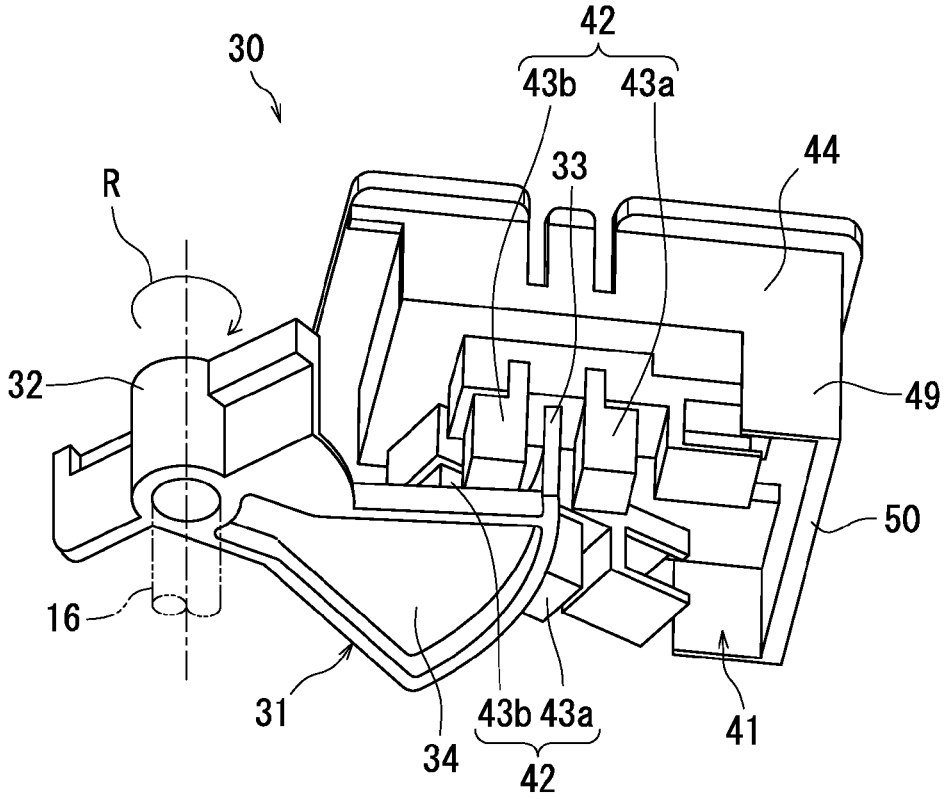
FIG. 7A is a perspective view showing an attachment detector included the sheet feeding device according to Embodiment 2 of the present invention.
Figure 7B:
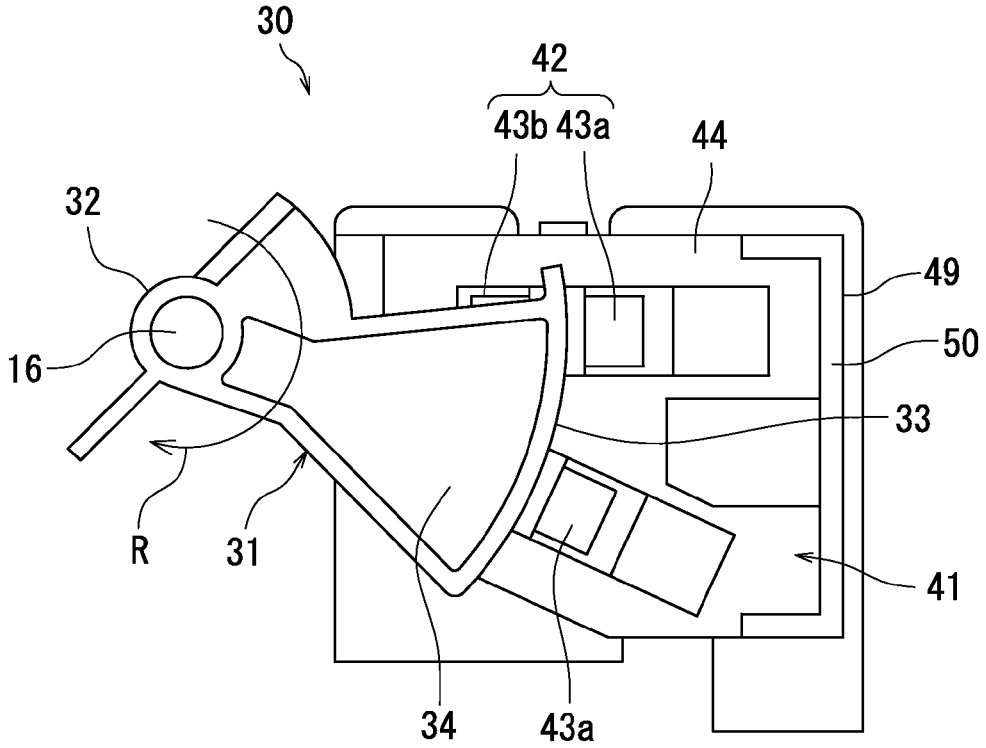
FIG. 7B is a plan view showing the attachment detector included the sheet feeding device according to Embodiment 2 of the present invention.

FIGS. 7A and 7B are respectively a perspective view and a plan view showing the attachment detector 30. The attachment-detection target member 31 and the attachment detecting member 41 are similar in structure to the attachment-detection target member 31 and the attachment detecting member 41 according to Embodiment 1 (see FIG. 4). However the sensor table 44 included in the attachment detecting member 41 according to Embodiment 2 differs from the sensor table 44 included in the attachment detecting member 41 according to Embodiment 1. The sensor table 44 according to Embodiment 2 has an abutting portion 49 disposed opposite to the outer wall 25. The abutting portion 49 extends in the pulling direction A1 (see FIG. 6).

[Structure of Size Detector 60]

With reference to FIG. 6, the structure of the size detector 60 is described. The size detector 60 includes the interlocking member 61 and the switch unit 81. The switch unit 81 is secured to the inner wall W of the cassette receiving section 101.

[Process of Detecting Sheet Size]

Figure 8A:
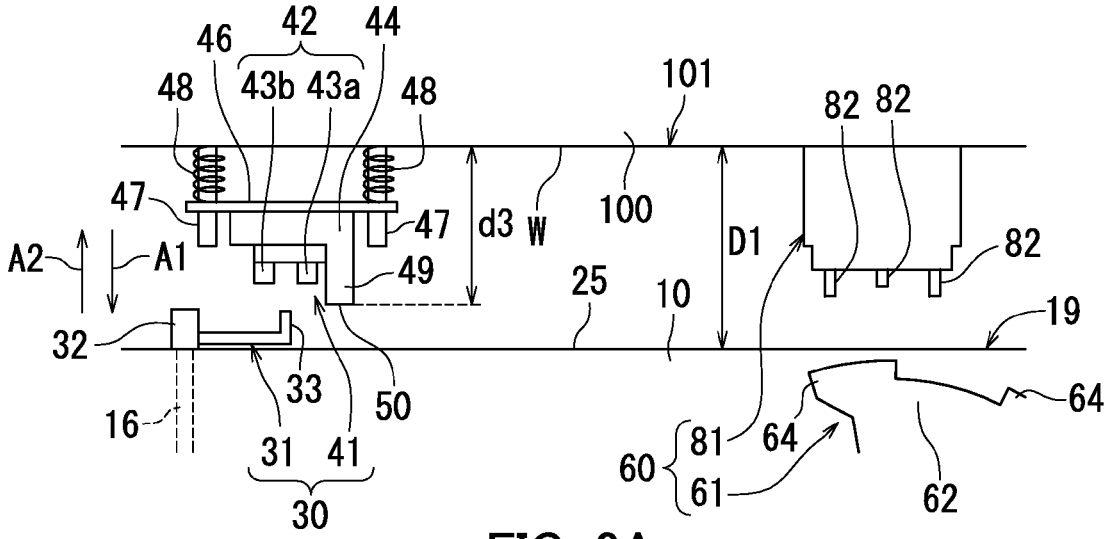
FIG. 8A illustrates a process of attaching a cassette of the sheet feeding device according to Embodiment 2 of the present invention to a cassette receiving section included in the image forming apparatus.
Figure 8B:
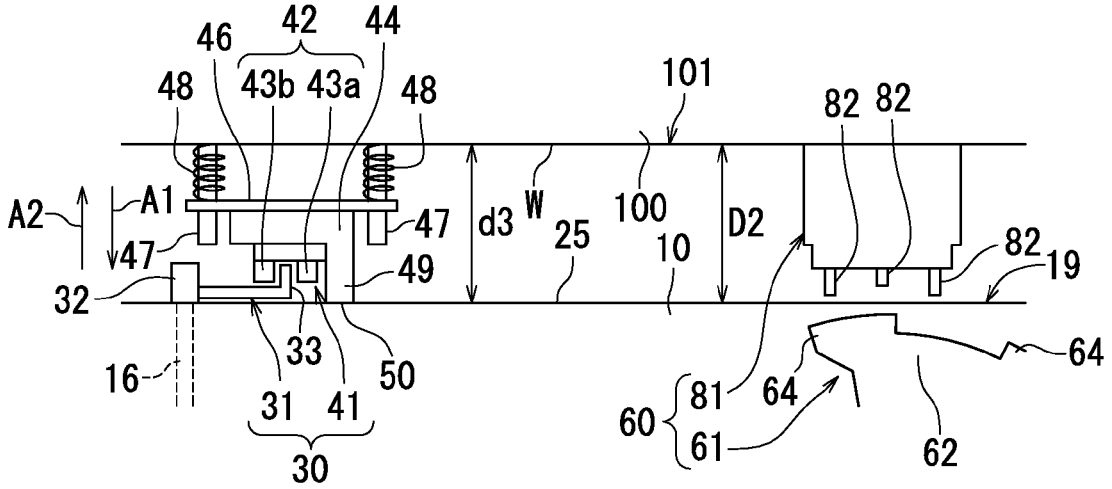
FIG. 8B illustrates the process of attaching the cassette of the sheet feeding device according to Embodiment 2 of the present invention to the cassette receiving section included in the image forming apparatus.
Figure 8C:
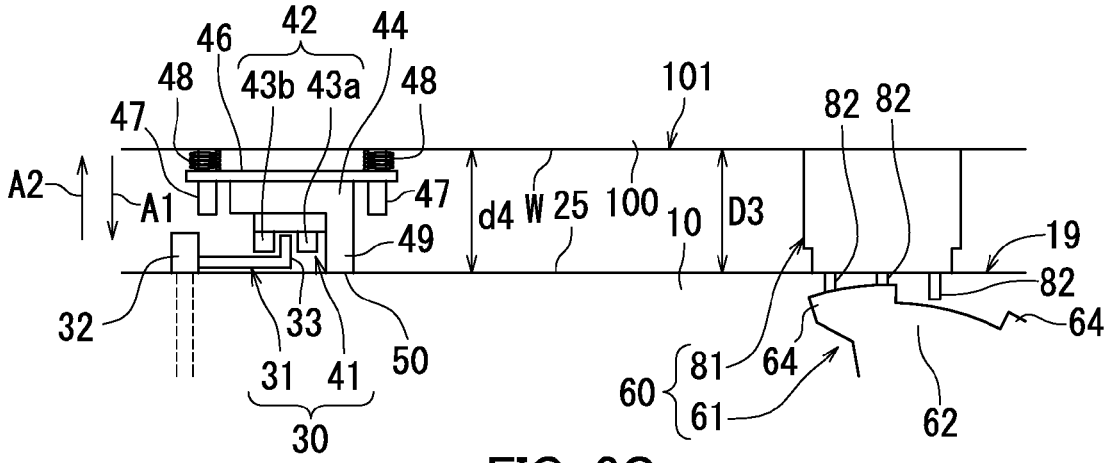
FIG. 8C illustrates the process of attaching the cassette of the sheet feeding device according to the Embodiment 2 of the present invention to the cassette receiving section included in the image forming apparatus.

With reference to FIGS. 8A to 8C, the process of detecting the size of sheets is described. FIGS. 8A to 8C show the process of attaching the cassette 10 to the cassette receiving section 101. FIG. 8A shows a state in which the attachment-detection target member 31 does not block the optical paths of the attachment detecting member 41 and the interlocking member 61 does not push any of the switches 82 of the switch unit 81. This state of the attachment detecting member 41 is referred to as a "standard state".

In the standard state, the attachment detecting member 41 is supported such that the distance between a tip end edge 50 of the abutting portion 49 and the inner wall W of the cassette receiving section 101 is equal to a prescribed distance d3. The following provides a more specific description.

Each guide member 47 of the attachment detector 30 is, for example, in a cylindrical shape and protrudes in the pulling direction A1 from the inner wall W. Each elastic member 48 is a spring, for example. The elastic member 48 is fitted over the corresponding guide member 47. In other words, the elastic member 48 is disposed on the inner wall W of the cassette receiving section 101. The guide members 47 are loosely received on the support member 46 at the respective ends. Each elastic member 48 is located between the support member 46 and the inner wall W so as to be extendable and contractible in the pulling direction A1 and the insertion direction A2.

A restricting member (not shown) prohibits the support member 46 from moving beyond the prescribed distance d3 in the pulling direction A1. The attachment detecting member 41 is secured to the support member 46. In the standard state, the attachment detecting member 41 is urged in the pulling direction A1 by the elastic member 48 while staying at the prescribed distance d3.

In FIG. 8A, the distance between the outer wall 25 of the cassette 10 and the inner wall W of the cassette receiving section 101 is denoted as a distance D1. FIG. 8B shows the state in which the cassette 10 is inserted further in the insertion direction A2 from the state shown in FIG. 8A. The distance between the outer wall 25 and the inner wall W is denoted as a distance D2 (<D1). In this state, none of the switches 82 is pushed. On the other hand, the attachment-detection target member 31 blocks one or more of the optical paths of the attachment-detection target portion 41. That is, the distal end surface 33 of the attachment-detection target portion 31 is inserted into a position between the light emitter 43*a* and the light receiver 43*b* of at least one of the sensors 42. As has been described above, the attachment detecting member 41 and the attachment-detection target member 31 are disposed such that the attachment detecting member 41 detects the attachment-detection target member 31 before the outer wall 25 of the cassette 10 abuts against the tip end edge 50 of the abutting portion 49. Thereafter, the tip end edge 50 of the abutting portion 49 abuts against the outer wall 25 of the cassette 10 moved in the insertion direction A2. Since FIG. 8B shows the state immediately after abutment of the tip end edge against the outer wall 25, the attachment detecting member 41 is still substantially in the standard state. The plurality of switches 82 and the plurality of size-detection target portions 64 are disposed such that detection of the size-detection target portions 64 by the plurality of switches 82 does not occur at the same time as abutment of the outer wall 25 of the cassette 10 against the tip end edge 50 of the abutting portion 49.

The state signal S1 of the attachment detecting member 41 is output to the controller 70 (see FIG. 1). Upon detecting a transition from the state signal S1 indicating that the optical paths are not blocked to the state signal S1 indicating that one or more of the optical paths are blocked, the controller 70 activates a timer (not illustrated) to start measuring a prescribed time period T.

From the state shown in FIG. 8B, the cassette 10 is further inserted in the insertion direction A2 against the elastic force of the elastic members 48. Then, the outer wall 25 eventually comes to press the abutting portion 49 in the insertion direction A2. As a result, the attachment-detection target member 31 and the attachment detecting member 41 move in the insertion direction A2 with the one or more optical paths of the attachment detecting member 41 remaining blocked by the attachment-detection target member 31. In other words, upon attachment of the cassette 10 to the cassette receiving section 101, the outer wall 25 of the cassette 10 presses the abutting portion 49, causing the attachment detecting member 41 to move in the insertion direction A2. FIG. 8C shows the state in which the cassette 10 is further inserted in the insertion direction A2 from the state shown in FIG. 8B to complete attachment of the cassette receiving section 101. The distance between the outer wall 25 and the inner wall W is denoted as a distance D3 (<D2). In this state, the attachment detection target portion 31 still blocks the one or more optical paths of the attachment-detection target portion 41. Meanwhile, two of the switches 82 are pushed by one of the size-detection target portions 64.

The state signal S2 of the switch unit 81 is output to the controller 70 (see FIG. 1). The controller 70 then detects the size of sheets loaded in the cassette 10 based on the state signal S2 of the switch unit 81 upon expiry of the prescribed time period T. The prescribed time period T is determined experimentally and/or empirically. The prescribed time period T may be equal to 0.

After detecting attachment of the cassette 10 and the size of sheets, the controller 70 detects the loading amount of sheets based on the state signal S1 that is responsive to the rotation of the attachment-detection target member 31. The attachment detecting member 41, the attachment-detection target member 31, the plurality of switches 82, and the plurality of size-detection target portions 64 are disposed such that a size-detection target portion 64 pushes a switch 82 after the attachment detecting member 41 detects the attachment-detection target member 31 upon attachment of the cassette 10 to the cassette receiving section 101 and then the outer wall 25 of the cassette 10 abuts against the abutting portion 49 and the outer wall 25 abuts against the abutting portion 49.

As has been described with reference to FIGS. 1, 2, and 6 to 8C, according to Embodiment 2, attachment of the cassette 10 is detected by the attachment detector 30 rather than by the size detector 60. Therefore, error in the sheet size detection by the controller 70 is restricted in a manner similar to Embodiment 1. In addition, the influence exerted by an attaching operation by a user on the sheet size detection can be reduced in a manner similar to Embodiment 1.

As has been described with reference to FIG. 7, according to Embodiment 2, the attachment detector 30 can detect attachment of the cassette 10 through the simple structure of detecting optical path blocking and costs can be reduced, in the same way as in Embodiment 1.

In addition, as described with reference to FIGS. 8A to 8C, according to Embodiment 2, the cassette 10 is attached to the cassette receiving section 101 through movement in the insertion direction A2 (first direction), whereas the elastic members 86 urge the attachment detecting member 41 in the pulling direction A1 (second direction) that is the reverse direction of the insertion direction A2. Consequently, impact associated with attachment of the cassette 10 can be absorbed by the elastic members 86.

Embodiment 3

Figure 9:
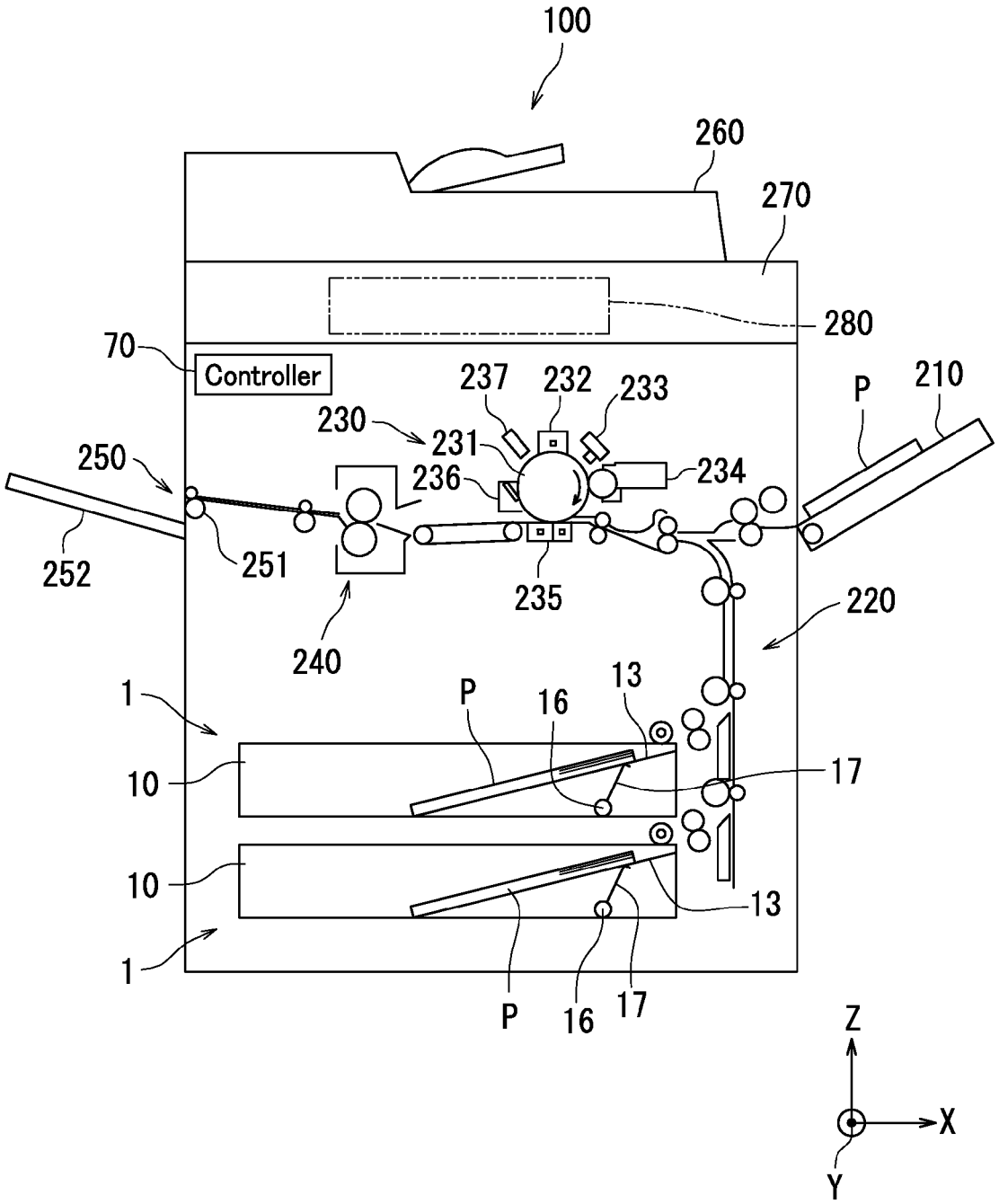
FIG. 9 is a schematic cross-sectional view illustrating an overview of an image forming apparatus according to Embodiment 3 of the present invention.

With reference to FIG. 9, an image forming apparatus 100 according to Embodiment 3 of the present invention is described. FIG. 9 is a schematic cross-sectional view illustrating an overview of the image forming apparatus 100 according to Embodiment 3 of the present invention. The image forming apparatus 100 is for example a copier, a printer, or a multifunction peripheral. The multifunction peripheral is equipped with at least two devices among, for example, a copier, a printer, and a facsimile machine.

The image forming apparatus 100 includes a sheet feeding device 1, a conveyance section 220, an image forming section 230, a fixing section 240, a discharging section 250, a document feeding section 260, an image reading section 270, an operation section 280, and a controller 70. The sheet feeding device 1 is similar to the sheet feeding device 1 according to Embodiment 1 or 2. Note that the controller 70 shown in FIG. 9 functions in the same way as the controller 70 shown in FIG. 1. The sheet feeding device 1 further includes a manual feed tray 210.

The operation section 280 outputs a control signal responsive to user operations to the controller 70. The user operations set various settings of the image forming apparatus 100.

The controller 70 includes for example a central processing unit (CPU) and a storage section (not shown). The storage section includes a main storage device (semiconductor memory, for example) and additionally includes an auxiliary storage device (semiconductor memory or hard disk drive, for example) depending on the specifications.

In accordance with control signals from the operation section 280 or a computer program, the controller 70 controls the sheet feeding device 1, the conveyance section 220, the image forming section 230, the fixing section 240, the discharging section 250, the document feeding section 260, the image reading section 270, and the operation section 280.

The document feeding section 260 feeds a document toward the image reading section 270. The image reading section 270 reads an image of the document to generate image data. The sheet feeding device 1 feeds a sheet P from the cassette 10 or the manual feed tray 210 to the conveyance section 220. Examples of sheets P include sheets of plain paper, recycled paper, thin paper, thick paper, coated paper, and overhead projector (OHP) film.

The conveyance section 220 conveys a sheet P to the image forming section 230. The image forming section 230 forms (prints) an image on a sheet S fed from the sheet feeding device 1 via the conveyance section 220. The image forming section 230 includes a photosensitive drum 231, a charging section 232, an exposure section 233, a development section 234, a transfer section 235, a cleaning section 236, and a static eliminating section 237. The following provides a more specific description.

The charging section 232 charges the surface of the photosensitive drum 231. The exposure section 233 exposes the surface of the photosensitive drum 231 to light based on the image data. As a result, an electrostatic latent image conforming to the image data is formed on the surface of the photosensitive drum 231. Examples of the image data include image data generated by the image reading section 270, image data stored in the storage section, and image data received via a network (not shown) from an external device (not shown).

The development section 234 causes toner to adhere to the electrostatic latent image to form a toner image on the surface of the photosensitive drum 231. The transfer section 235 causes the toner image to be transferred to a sheet P. The cleaning section 236 removes residual toner from the surface of the photosensitive drum 231. The static eliminating section 237 eliminates the residual charge on the surface of the photosensitive drum 231.

The sheet P having the toner image transferred thereto is conveyed toward the fixing section 240. The fixing section 240 applies heat and pressure to the sheet P to fix the toner image on the sheet P. The sheet P having the toner image transferred thereto is conveyed toward the discharging section 250. The discharging section 250 includes a pair of ejection rollers 251 and an ejection tray 252. The pair of ejection rollers 251 discharges the sheet P onto the ejection tray 252.

As has been described with reference to FIG. 9, the image forming apparatus 100 according to Embodiment 3 includes the sheet feeding device 1 according to Embodiment 1 or 2. Therefore, similarly to Embodiment 1 or 2, error in the sheet size detection by the controller 70 is restricted. Additionally, Embodiment 3 achieves the advantageous effects similar to the advantageous effects of Embodiment 1 or 2.

The above have described the embodiments of the present invention with reference to the drawings (FIGS. 1 to 9). The present invention, however, is not limited to the embodiments described above and can be carried out in various manners without departing from the essence thereof. For example, alterations such as those described below ((1) to (4)) may be possible. The figures are schematic illustrations mainly showing the component elements to facilitate a clear understanding. The thicknesses, lengths, numbers, and other properties of the component elements in the figures may differ from the actual ones for the sake of convenience in the drawings. In addition, the shapes, sizes, and other properties of the component elements described in the above embodiments are merely examples and are not to be construed as limiting. Various alterations may be made without substantially departing from the advantageous effects of the present invention.

(1) As shown in FIGS. 5A to 5C and FIGS. 8A to 8C, the switch unit 81 includes three switches 82. Meanwhile, the number of switches 82 is not limited to three. Two switches 82 or four or more switches 82 may be provided. In addition, the interlocking member 61 includes four size-detection target portions 64. However, the number of the size-detection target portions 64 is not limited to four. Two or three size-detection target portions 64 or five or more size-detection target portions 64 may be provided.

(2) As shown in FIGS. 3 and 6, the interlocking member 61 moves in conjunction with movement of the rear-edge regulating member 11. However, the interlocking member 61 may move in conjunction with movement of one or more of the side-edge regulating members 12 or movement of both the rear-edge regulating member 11 and one or more of the side-edge regulating members 12.

(3) As shown in FIGS. 4A and 4B and FIGS. 7A and 7B, the attachment detecting member 41 is provided with two sensors 42. However, one sensor or three or more sensors 42 may be provided.

(4) In FIGS. 5A to 5C, the outer wall 25 of the cassette 10 abuts against the abutting surface 87 of the switch unit 81. In FIGS. 8A to 8C, the outer wall 25 of the cassette 10 abuts against the abutting portion 49 of the attachment detecting member 41. However, the portion that abuts against the abutting surface 87 or the abutting portion 49 is not limited to the outer wall 25 of the cassette 10 and may be another portion of the cassette 10 or a member disposed on the cassette 10.

INDUSTRIAL APPLICABILITY

The present invention is applicable to the field of a sheet feeding device that feeds sheets or the field of image forming apparatuses having such a sheet feeding device.

The invention claimed is:

1. A sheet feeding device comprising:

a cassette receiving section;

a cassette configured to be detachably attached to the cassette receiving section and to be loaded with a plurality of sheets;

a size detector configured to detect a size of the sheets loaded in the cassette;

an attachment detector configured to detect attachment of the cassette to the cassette receiving section; and a controller, wherein the cassette includes a regulating member configured to be slidable relative to the cassette and align edges of the sheets, the size detector includes an interlocking member that is disposed on the cassette and includes a plurality of size-detection target portions, the interlocking member being configured to move in conjunction with sliding of the regulating member, and a switch unit that is disposed on an inner wall of the cassette receiving section so as to be opposite to the cassette and includes a plurality of switches, the switch unit is configured to detect a position of the regulating member based on a state of the plurality of switches that detect the plurality of size-detection target portions, the attachment detector includes an attachment-detection target member disposed on the cassette, and an attachment detecting member that is disposed on the inner wall of the cassette receiving section so as to be spaced from the switch unit and opposite to the attachment-detection target member, the attachment detecting member being configured to detect the attachment-detection target member in response to attachment of the cassette to the cassette receiving section, the cassette further includes a loading member configured to be loaded with the plurality of sheets, a shaft configured to rotate according to a loading amount of the plurality of sheets, and a lift member configured to abut against a lower surface of the loading member and rotate with the shaft so as to lift up and down the loading member, the lower surface being opposite to a loading surface of the loading member on which the plurality of sheets are loaded, the attachment detector is a loading amount detector configured to detect the loading amount of the plurality of sheets loaded on the loading member, the attachment-detection target member is disposed at an end of the shaft so as to rotate integrally with the shaft, the attachment detecting member includes a plurality of sensors arranged along a rotation direction of the attachment-detection target member, at least one of the plurality of sensors detects blocking of a corresponding optical path by the attachment-detection target member upon attachment of the cassette to the cassette receiving section and at least one of the plurality of sensors detects blocking of a corresponding optical path by the attachment-detection target member upon rotation of the attachment-detection target member in conjunction with rotation of the shaft, and the controller is configured to detect the loading amount based on a state of the plurality of sensors, and to detect the size of the sheets based on a state of the switch unit in response to the attachment detector detecting attachment of the cassette to the cassette receiving section.

2. An image forming apparatus comprising:

the sheet feeding device according to claim 1; and an image forming section configured to form an image on a sheet fed from the sheet feeding device.

3. A sheet feeding device comprising:

a cassette receiving section;

a cassette configured to be detachably attached to the cassette receiving section and to be loaded with a plurality of sheets;

a size detector configured to detect a size of the sheets loaded in the cassette;

an attachment detector configured to detect attachment of the cassette to the cassette receiving section; and a controller, wherein the cassette includes a regulating member configured to be slidable relative to the cassette and align edges of the sheets, the size detector includes an interlocking member that is disposed on the cassette and includes a plurality of size-detection target portions, the interlocking members being configured to move in conjunction with sliding of the regulating member, and a switch unit that is disposed on an inner wall of the cassette receiving section so as to be opposite to the cassette and includes a plurality of switches, the switch unit is configured to detect a position of the regulating member based on a state of the plurality of switches that detect the plurality of size-detection target portions, the attachment detector includes an attachment-detection target member disposed on the cassette, and an attachment detecting member that is disposed on the inner wall of the cassette receiving section so as to be spaced from the switch unit and opposite to the attachment-detection target member, the attachment detecting member being configured to detect the attachment-detection target member in response to attachment of the cassette to the cassette receiving section, the attachment detecting member is configured to detect the attachment-detection target member after at least one of the plurality of switches detects one of the size-detection target portions upon attachment of the cassette to the cassette receiving section, and the controller is configured to detect the size of the sheets based on a state of the switch unit in response to the attachment detector detecting attachment of the cassette to the cassette receiving section.

4. The sheet feeding device according to claim 3, wherein the cassette is configured to be attached to the cassette receiving section through movement in a first direction and pulled out of the cassette receiving section though movement in a second direction that is a reverse direction of the first direction, the size detector further includes a first elastic member configured to urge the switch unit in the second direction, and the first elastic member is disposed on the inner wall of the cassette receiving section so as to be contractible and extendable in the first direction and the second direction.

5. The sheet feeding device according to claim 4, wherein the switch unit has an abutting surface that is opposite to an outer wall of the cassette, and upon attachment of the cassette to the cassette receiving section, the outer wall presses the abutting surface and the switch unit moves in the first direction.

6. The sheet feeding device according to claim 5, wherein the plurality of switches protrude in the second direction from the abutting surface, and the plurality of switches, the plurality of size-detection target portions, the attachment detecting member, and the attachment-detection target member are disposed such that the outer wall of the cassette abuts against the abutting surface after the one of the size-detection target portions presses the at least one of the plurality of switches in the first direction upon attachment of the cassette to the cassette receiving section, and the attachment detecting member detects the attachment-detection target member after the outer wall abuts against the abutting surface.

7. An image forming apparatus comprising:

the sheet feeding device according to claim 3, and an image forming section configured to form an image on a sheet fed from the sheet feeding device.

8. A sheet feeding device comprising:

a cassette receiving section;

a cassette configured to be detachably attached to the cassette receiving section and to be loaded with a plurality of sheets;

a size detector configured to detect a size of the sheets loaded in the cassette;

an attachment detector configured to detect attachment of the cassette to the cassette receiving section; and a controller, wherein the cassette includes a regulating member configured to be slidable relative to the cassette and align edges of the sheets, the size detector includes an interlocking member that is disposed on the cassette and includes a plurality of size-detection target portions, the interlocking member being configured to move in conjunction with sliding of the regulating member, and a switch unit that is disposed on an inner wall of the cassette receiving section so as to be opposite to the cassette and includes a plurality of switches, the switch unit is configured to detect a position of the regulating member based on a state of the plurality of switches that detect the plurality of size-detection target portions, the attachment detector includes an attachment-detection target member disposed on the cassette, and an attachment detecting member that is disposed on the inner wall of the cassette receiving section so as to be spaced from the switch unit and opposite to the attachment-detection target member, the attachment detecting member being configured to detect the attachment-detection target member in response to attachment of the cassette to the cassette receiving section, the cassette is configured to be attached to the cassette receiving section through movement in a first direction and pulled out of the cassette receiving section though movement in a second direction that is a reverse direction of the first direction, the attachment detector includes a second elastic member configured to urge the attachment detecting member in the second direction, and the second elastic member is disposed on the inner wall of the cassette receiving section so as to be contractible and extendable in the first direction and the second direction, the attachment detecting member is configured to detect the attachment-detection target member before any of the plurality of switches detects any of the size-detection target portions upon attachment of the cassette to the cassette receiving section, and the controller is configured to detect the size of the sheets based on a state of the switch unit in response to the attachment detector detecting attachment of the cassette to the cassette receiving section.

9. The sheet feeding device according to claim 8, wherein the attachment detecting member has an abutting portion that is opposite to an outer wall of the cassette, and upon attachment of the cassette to the cassette receiving section, the outer wall presses the abutting portion and the attachment detecting member moves in the first direction.

10. An image forming apparatus comprising:

the sheet feeding device according to claim 8; and an image forming section configured to form an image on a sheet fed from the sheet feeding device.

* * * * *